US008059982B2

(12) United States Patent
Carlson et al.

(10) Patent No.: US 8,059,982 B2
(45) Date of Patent: Nov. 15, 2011

(54) PRINTING DEVICE WITH LAMINATING FUNCTIONALITY

(75) Inventors: Gary Carlson, Bois, ID (US); George McIlvaine, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1238 days.

(21) Appl. No.: 10/763,352

(22) Filed: Jan. 23, 2004

(65) Prior Publication Data

US 2005/0163522 A1 Jul. 28, 2005

(51) Int. Cl.
*G03G 15/20* (2006.01)

(52) U.S. Cl. ..... 399/67; 399/342

(58) Field of Classification Search ..... 399/67, 399/342, 66, 68, 69, 407, 45, 376, 44; 347/262
See application file for complete search history.

(56) References Cited

U.S. PATENT DOCUMENTS 4,549,803 A * 10/1985 Ohno et al. ..... 399/45
4,756,963 A * 7/1988 Yamamoto et al. ..... 428/32.81
5,126,797 A * 6/1992 Forest et al. ..... 399/342
5,217,561 A * 6/1993 Ueda et al. ..... 156/359
5,369,246 A * 11/1994 Nanos ..... 219/388
5,421,947 A * 6/1995 Green ..... 156/464
5,447,462 A * 9/1995 Smith et al. ..... 450/122
5,878,303 A * 3/1999 Endo ..... 399/85
5,894,318 A * 4/1999 Endo ..... 347/262
6,516,178 B2 * 2/2003 Fukushima ..... 399/376
6,717,521 B1 * 4/2004 Leung ..... 340/675
6,816,686 B2 * 11/2004 Hooper et al. ..... 399/44
2004/0081494 A1 * 4/2004 Bhatti et al. ..... 399/342

FOREIGN PATENT DOCUMENTS

JP 06011980 A * 1/1994
JP 07295408 A * 11/1995
JP 09138601 A * 5/1997
JP 10010933 A * 1/1998
JP 2003285484 A * 10/2003

* cited by examiner

*Primary Examiner* — Quana M Grainger

(57) ABSTRACT

A method of using a printing device having a toner fuser to laminate a media sheet with at least one laminate material sheet, the method including receiving a laminate request, adjusting a characteristic of the toner fuser of the printing device, and passing the media sheet and the at least one laminate material sheet through the toner fuser to effect lamination within the printing device.

15 Claims, 4 Drawing Sheets

PRINTING DEVICE WITH LAMINATING FUNCTIONALITY

BACKGROUND

Printing devices are widely used in business, education, and personal settings for creating hardcopy documents of various types. Such devices generally are capable of printing on different types of media, including cellulose-based media, such as paper, polymer-based material, such as transparency overheads, and other media. The ability to print on a wide variety of media types further enhances the printing device's functionality.

Hardcopy documents are sometimes used in applications where excessive wear and tear is an issue. For example, signs, name badges, checklists, etc., may be subjected to rough handling or extended use, and thus may be subject to accelerated deterioration. Cellulose-based media can be especially susceptible to this type of deterioration, because of its structure and porosity.

A laminating technique may be used to protect cellulose-based media that is used in one of the aforementioned situations. For example, laminating cellulose-based media protects it from absorbing dirt and oils during handling that can accelerate its deterioration. Laminating techniques may involve application of heat and/or pressure to secure a laminating material to a media sheet.

Although some printers employ heat and pressure to fuse toner to media, such printers heretofore have not been well-suited to effect laminating due at least in part to differences between the heat and pressure characteristics of toner fusers employed in printing, and the heat and pressure characteristics desired in known laminating techniques. Such printers also have not previously considered the differential feed paths which may be desired to deliver laminating material into operative relation with a media sheet in order to effect laminating of such media sheet.

DETAILED DESCRIPTION

Figure 1:
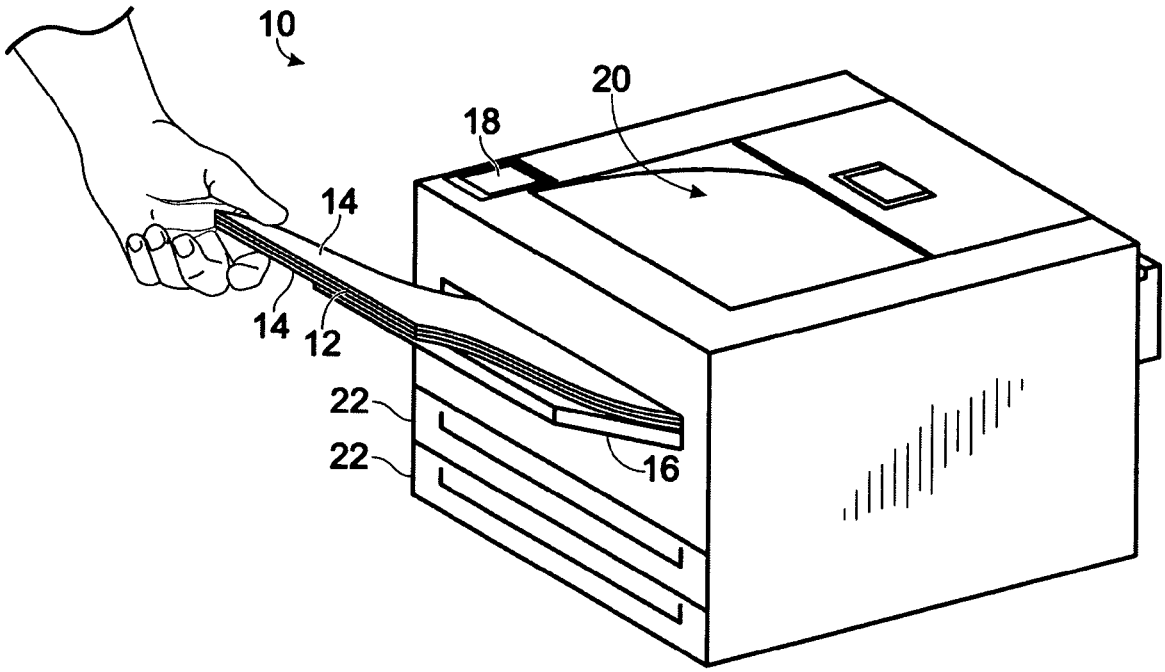
FIG. 1 is a perspective view of a printing device according to an embodiment of the invention.

An exemplary printing device, configured to laminate documents, is generally indicated at 10, in FIG. 1. A document 12, sandwiched between sheets of laminating material 14, is shown being fed into a manual feed tray 16 of printing device 10. Laminating material 14 may take the form of a transparent plastic or thermoplastic which may be adhered to document 12 by application of heat, pressure, and/or through the use of an adhesive.

Printing device 10 includes a control panel 18 configured to receive manual input from a user directing operation of the printing device. The printing device further may include an output tray 20, which collects printed documents as they emerge. In operation, the printing device may be connected to a computer or a computer network (not shown), such that the printing device can receive print jobs for printing.

Figure 2:
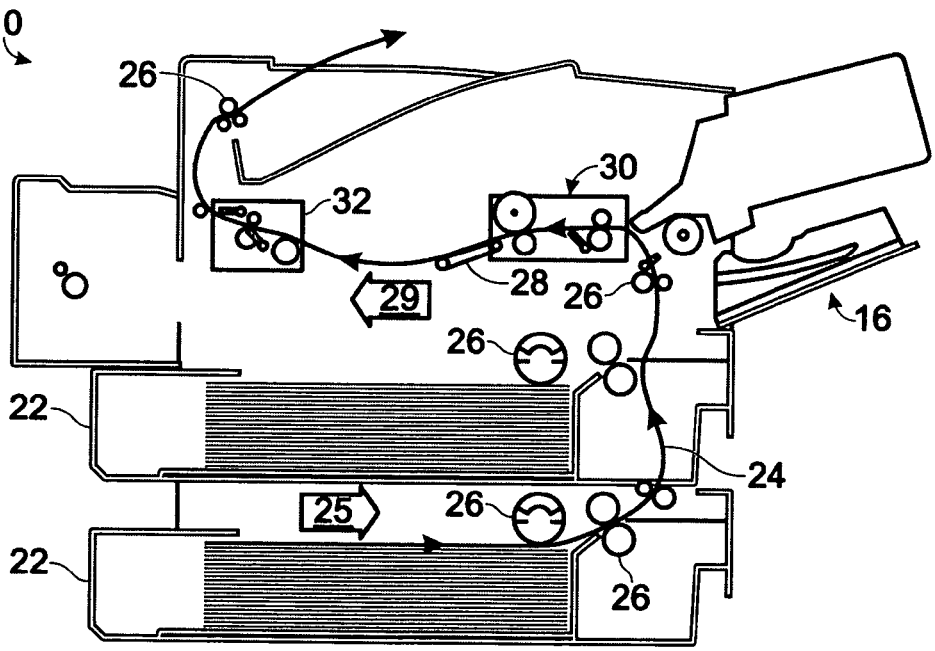
FIG. 2 is a schematic sectioned side view of a printing device according to an embodiment of the invention, illustrating an exemplary media-transport path

FIG. 2 illustrates a cross-section of exemplary printing device 10, showing schematically, the internal structure thereof. Printing device 10 includes one or more automatic feed media trays 22 configured to store paper to be introduced into a media-transport path 24. The printing device may include a plurality of possible media-transport paths, depending on the configuration of the printing device. A plurality of rollers 26, belts 28, and other mechanisms combine to move media along media-transport path 24 through the printing device 10.

An image-transfer mechanism 30 may be positioned along path 24 and configured to transfer a toner image onto media passing therethrough. A fuser 32 may be positioned downstream from mechanism 30 and configured to fuse, or melt, the toner image onto the media passing therethrough. Additionally, as described further below, fuser 32 may be configured to laminate a document between sheets of laminating material, or apply a laminate sheet of material to one side of the document.

Figure 3:
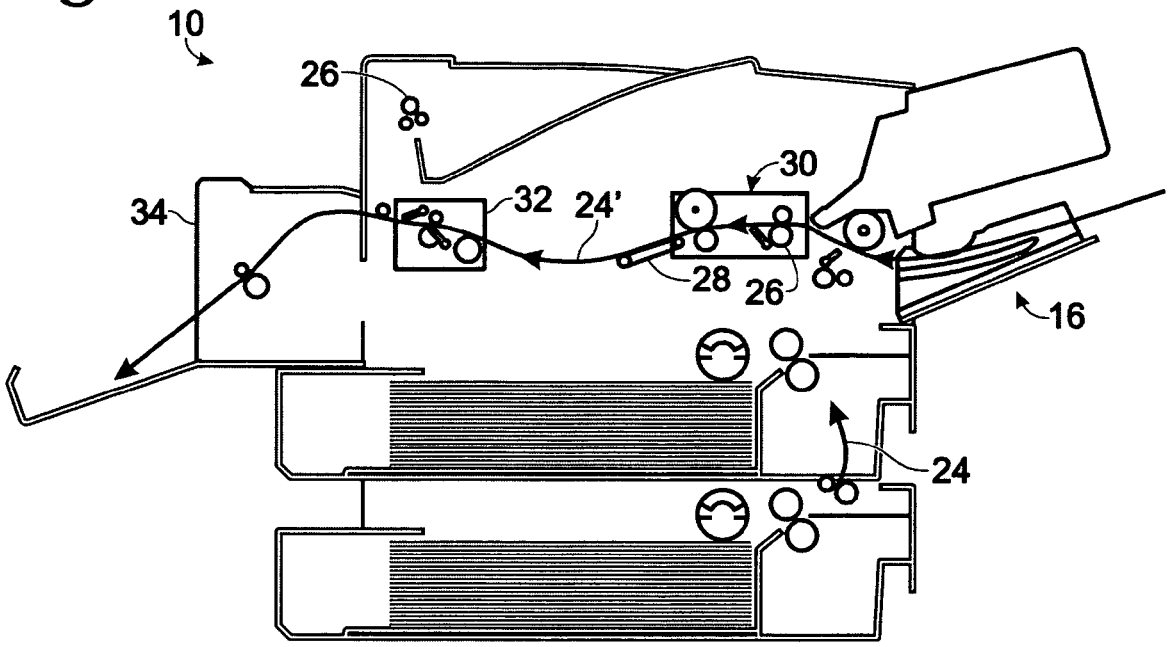
FIG. 3 is a schematic sectioned side view of the printing device of FIG. 2, illustrating an alternate media-transport path.

Referring now to FIGS. 2 and 3, where image-transfer mechanism 30 and fuser 32 are illustrated in some detail, it will be understood that the printing device may be configured to enable a document to be laminated between sheets of laminating material. This may be accomplished by feeding a document sandwiched between sheets of laminating material into media-transport path 24, which then carries the sandwiched document through fuser 32. As used herein, a document sandwiched between sheets of laminating material may be referred to as a sandwiched document, or as composite media. For reasons that will become apparent, fuser 32 may vary its speed, temperature, and pressure in order to provide a laminating function in printing device 10.

In typical operation, illustrated in FIG. 2, media-transport path 24 picks up media from one of paper trays 22, and transports it along a curved path through printing device 10. The curved path of media-transport path 24 may fold back over itself as it transports media through the printing device. A path that folds back on itself may initially move media in a first direction, as indicated by arrow 25, and subsequently move media in a second direction substantially different from to the first direction, as indicated by arrow 29.

Media-transport path 24 may be configured to carry media, often paper, through an image-transfer mechanism 30. A fuser 32 may be located downstream from image-transfer mechanism 30, also along media-transport path 24, such that media with an image transferred thereon passes through the fuser after the image-transfer mechanism.

In an embodiment not depicted, the printing device may include laminate material in one of the automatic feed trays and print media in another automatic feed tray. The printing device may be configured to assemble composite media, by first printing on print media, and then sandwiching the printed-on print media between sheets of laminate material. A media handling structure may be constructed to accomplish a composite media assembly.

An alternative media-transport path 24' is illustrated in FIG. 3. Media-transport path 24' provides a less curved path through printing device 10 than media-transport path 24. As shown, media-transport path 24' receives media, often paper, from manual feed tray 16. Like media-transport path 24, media-transport path 24' carries the media received, first through image-transfer mechanism 30 and then through fuser 32.

It should be noted, that media-transfer path 24' does not fold back on itself in the same way as media-transport path 24. That is to say, that media-transport path 24' is relatively straight when compared with media-transport path 24. Providing a relatively straight path, as media-transport path 24' does, enables printing device 10 to handle heavier media and allows it to transport composite media without significant bending or misalignment. An output door 34 may be positioned downstream of fuser 32 to provide an exit from media-transport path 24' without causing composite media to travel through a sharp curve. It will be noted that media-transport path 24' moves media substantially in the first direction, and does not fold the media back on itself to move the media in the second direction.

In another embodiment, the media-transport path bypasses the image-transfer mechanism. Bypassing the image-transfer mechanism may provide advantages when laminating certain composite media configurations.

If composite media must travel a highly curved media-transport path through the printing device, then the chance of the layers of the composite media becoming misaligned increases. If one layer moves faster relative to the other layers, then a misalignment may occur. As a sheet of media travels around a curve in the media-transport path, the surface, or layer (in the case of composite media), closest to the inside of the curve travels a shorter distance than the surface on the outside of the curve. A disparity in distance traveled, such as this, if not properly compensated for, could cause layers in a composite media to shift relative to one another. This shifting may be reduced where the curves in the media-transport path are limited or reduced.

As noted above, printing device 10 includes an image-transfer mechanism 30 configured to apply a toner image to media passing through the image-transfer mechanism. In a laser printing device, for example, image-transfer mechanism 30 may be configured to include a laser-scanning unit, a photoreceptor drum, a developer roller, a toner source, a photoreceptor-charge applicator, a discharge lamp, and a media-charge applicator. Other configurations of the mechanism 30 are possible.

In a laser printing device, the image-transfer mechanism typically transfers an image onto a media by initially charging the photoreceptor drum with the photoreceptor-charge applicator to give it a uniform positive charge. The laser-scanning unit shines a small laser across the photoreceptor drum to discharge certain portions thereof forming a negative of the image to be printed.

As the discharged portions pass over the developer roller, toner that is on the developer roller electro-statically adheres to the photoreceptor drum. With the toner adhered to the photoreceptor drum, the drum is rolled over the media. In order to cause the toner to leave the photoreceptor drum and transfer to the media, it has to be given a stronger negative charge than the negative charge on the photoreceptor drum. Being attracted to this stronger negative charge causes the toner to transfer to the media. Thus, a positive image is transferred from the negative of the photoreceptor drum to the media.

When composite media is being transported through image-transfer mechanism 30, the image-transfer mechanism may be configured to permit the composite media to pass through without placing an image thereon. Composite media may be identified by user input, or based on optical, electrical or other observation of media upon input. It may be possible to achieve the aforementioned bypass by not charging the composite media, or not scanning the laser across the photoreceptor, or a combination of these. Absent charging the composite media, and/or scanning the laser across the photoreceptor, an image will not be transferred to the composite media.

The toner is cured, or bonded, to paper or other media when it passes through a fuser, such as fuser 32 of printing device 10. Fuser 32 applies heat to the media that causes the toner to melt and adhere to the media. Shown schematically in FIG. 4, a typical fuser, such as fuser 32, includes a pair of heated rollers 36 that may be positioned one on top of the other and configured for counter rotation to pull media through between the two rollers. Typically, one of rollers 36 will be heated by a heating element 38. Alternatively, both rollers 36 may be heated by heating element 38. Pressure may be applied to media in the fuser by a movement mechanism 40, which may be configured to adjustably force the fuser rollers together.

In the present embodiment, it is the fuser of printing device 10 that enables the laminating function of the printing device. As noted above, a fuser nominally is configured only to melt toner onto the underlying media so as to form a permanent image on the media. In exemplary printing device 10, however, fuser 32 includes additional functionality that makes it possible to use fuser 32 to laminate a document between sheets of laminating material. This additional functionality may include the ability to increase/decrease the rolling pressure between the stacked rollers of the fuser and/or the heat applied via the stacked roller of the fuser.

Figure 4:
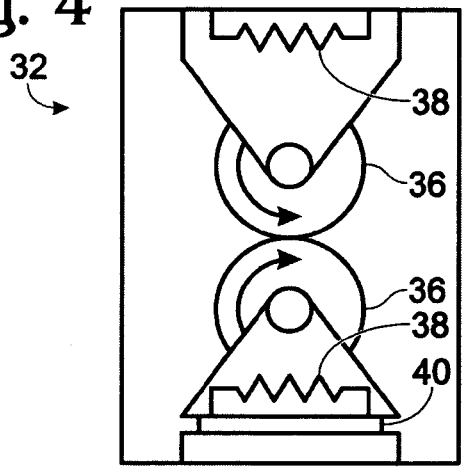
FIG. 4 is a schematic representation of a fuser according to an embodiment of the invention.

As illustrated in FIG. 4, one or both of the rollers may be movably mounted so that force can be applied to the interface between the rollers increasing the pressure experienced by media passing between the rollers. A movement mechanism 40 may be used to facilitate applying a force between fuser rollers 36. Typically, movement mechanism 40 may be an servo motor, or similar electro-mechanical structure for applying pressure.

Heating elements 38 of fuser 32 also may be adjustable to increase, or decrease, the temperature of fuser rollers 38 to optimize the temperature for melting the laminating material. For example, heating elements 38 may employ variable-resistance heating elements that can be precisely controlled. It may also be desirable to adjust the rotation speed of the rollers of fuser 32 so as to optimize the time a composite media spends between the heated rollers. Precise control of temperature, pressure and speed enables a variety of laminate materials to be used to laminate a document.

Controlling the speed of fuser rollers 36 may be accomplished using electric motors that respond to variations in electrical current. Varying the electrical current causes the electric motor to speed up or slow down, thus controlling the speed of fuser rollers 36. Typically all rollers 26 and belts 28 will be synchronized so that the speed of composite media is controlled carefully through the entire media-transport path.

It should be noted that, in some cases, it may be desirable to print on the laminate material. This may be accomplished in the same manner as described above for typical media using the image-transfer mechanism. When the composite media, with the image transferred thereon, passes through the fuser it both fuses the image to the composite media, as well as laminates the composite media.

Figure 5:
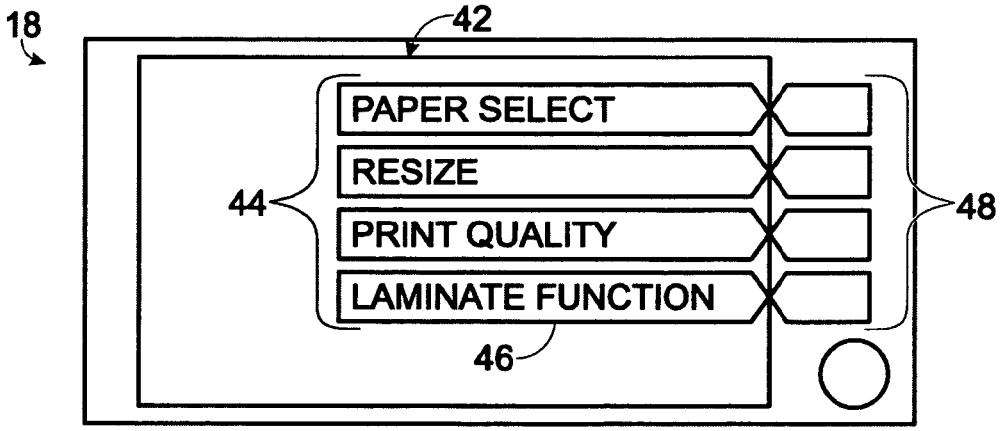
FIG. 5 is a schematic representation of a control panel of a printing device according to an embodiment of the invention, illustrating a laminate function.
Figure 6:
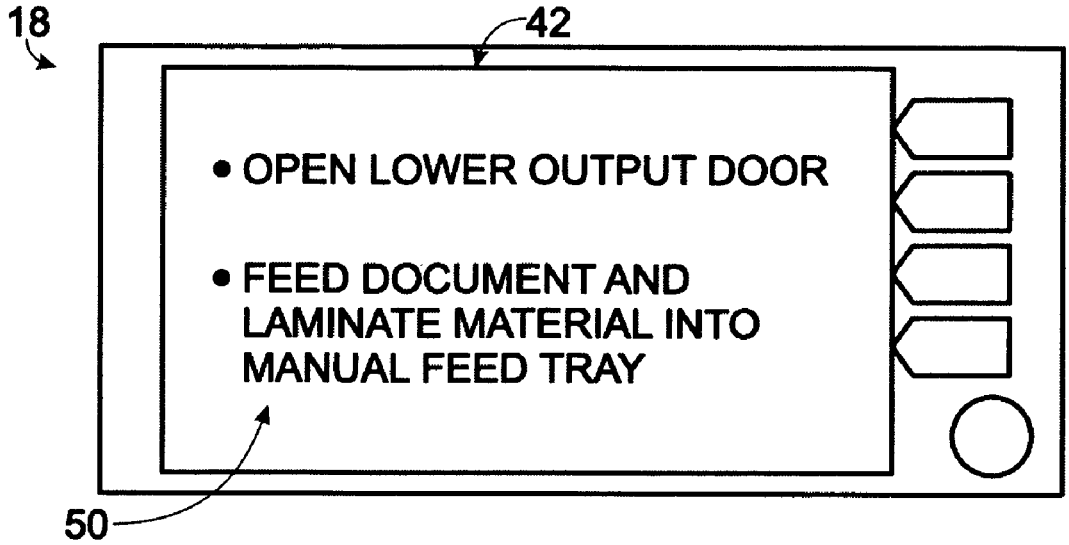
FIG. 6 is a schematic representation of the control panel of FIG. 5, but illustrating exemplary configuration instructions.
Figure 7:
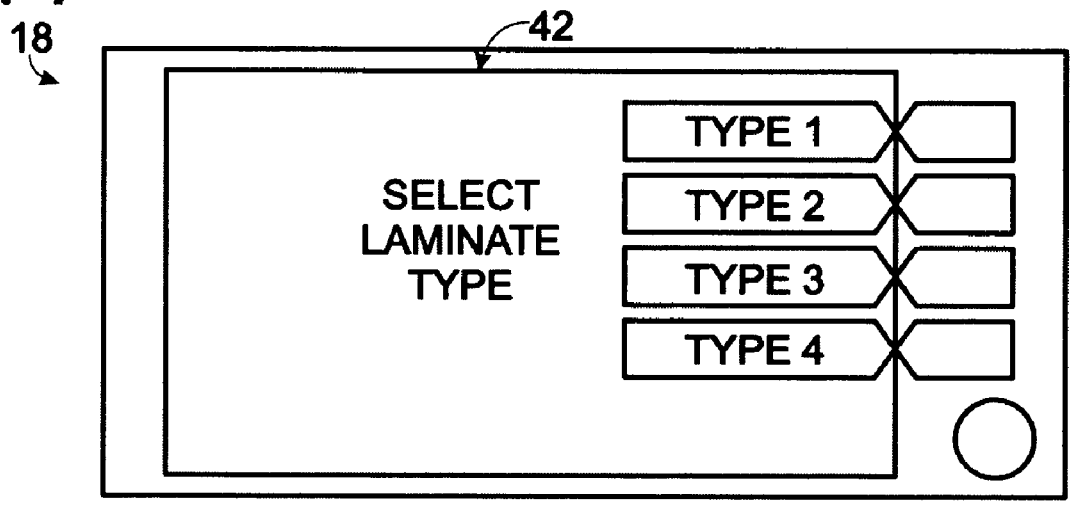
FIG. 7 is a schematic representation of the control panel of FIG. 5, but illustrating a selection of laminate material types.

FIGS. 5-7 illustrate exemplary interactions between a user of printing device 10 and control panel 18 when the user is using the printing device's laminating function. FIG. 5 shows a display screen 42 having a menu of functions 44 displayed thereon. Typically, control panel 18 displays this menu of functions when the printing device is in an idle state. Printing device 10 is in an idle state when it is not currently printing a print job. The menu of functions may include a laminate function 46 that a user may select using a corresponding one of user-selectable keys 48 on control panel 18. It will be understood that other user-selectable mechanisms may be used to permit a user to interact with control panel 18, such as, a touch sensitive screen, etc.

Once laminate function 46 is selected, if printing device 10 employs any manual configuration to achieve the laminating function, display screen 42 on control panel 18 will provide a set of instructions to the user for configuring the printing device, as illustrated generally at 50 in FIG. 6. Instructions 50 may consist of text and graphics that communicate how to configure the printing device for the laminating function. For example, display screen 42 may include text, such as, "Open lower output door," and "Feed composite media into manual feed tray." The text may be accompanied by graphics illustrating the steps, or graphics may be used instead of the text.

It will be understood that a wide variety of printing device configurations may be possible. Not all printing device configurations will employ the same manual configuration steps to ready the printing device for executing a lamination function. As indicated previously, in some printing device configurations, the laminating material may be stored in a laminating material tray. In such a printing device configuration, the printing device may be configured to assemble composite media automatically. In other configurations the user may have to assemble the composite material and feed it into the manual feed tray to execute the laminate function.

The laminate function of printing device 10 may be configured to laminate different types of laminate material. Different laminate materials may require different temperatures and pressures to laminate properly. A laminate material type selection may be presented to a user on display screen 42 of control panel 18.

This user selection may take a variety of forms, for example, a manufacturer may produce a proprietary line of laminate material for use with a printing device configured to laminate documents. Display screen 42 of control panel 18 may prompt a user to select a type of laminate material. The selection menu may be based on the proprietary line of laminate materials so that the printing device can adjust the fuser temperature, pressure, and speed precisely to optimize the laminating function, as illustrated in FIG. 7. Alternatively, the user may input a fuser temperature, pressure, and speed based on manufacturer recommendations provided by the laminate material manufacturer, or after a trial-and-error session determining the correct settings for a specific laminating material.

Figure 8:
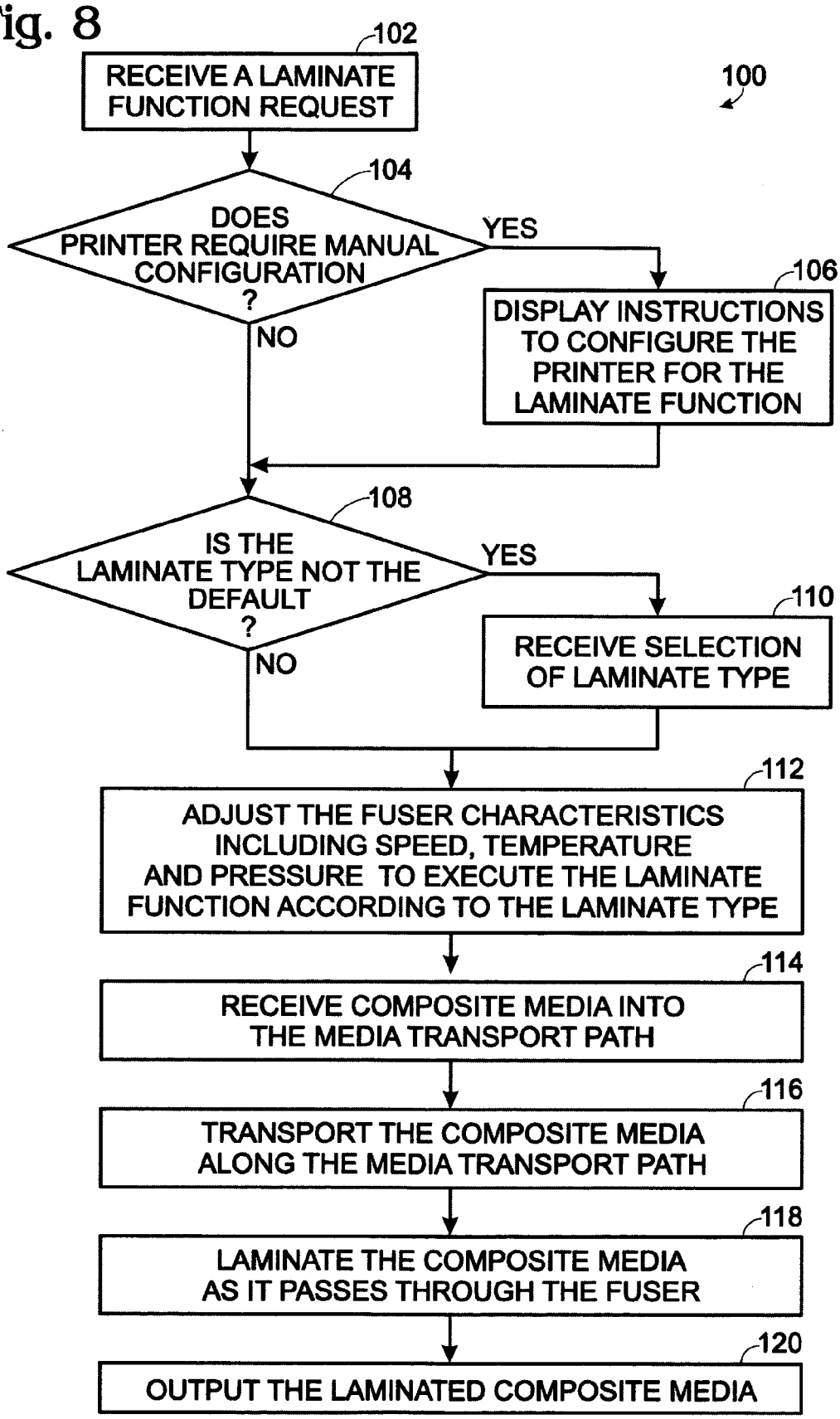
FIG. 8 is a flow chart illustrating a method for laminating a document according to an embodiment of the invention.

FIG. 8 is a flow chart of an embodiment of a method of laminating composite media using a printing device, as generally indicated at 100. The printing device receives a laminate function request from a user, as indicated at 102. The laminate function request may be received at a control panel on the printing device, or may be received as a command sent from a computer attached, either directly or through a network, to the printing device.

If the laminate function request requires manual configuration, as indicated at 104, then the printing device displays instructions for configuring the printing device for the laminate function on the printing device display, as indicated at 106. If the printing device does not require manual configuration, then the printing device queries if the laminate type is a default type of laminate material, as indicated at 108. For example, a printing device that includes a laminate function may be manufactured to accommodate a specific lamination task and may only accept a particular type of laminate material, such as thermoplastic laminate sheets of a specific weight. In this example, the default media is the only type of media that the printing device accommodates. In other embodiments, the printing device may be capable of handling a variety of lamination materials, and thus may provide for identification of a selected laminating material by a user or network administrator and corresponding adjustment of fuser characteristics to accommodate the identified laminating material type.

Accordingly, if the laminate type is not the default type, an alternative type of laminate may be selected, as indicated at 110. The selection of laminate type may include selecting a specific laminate type from a menu of options, or may include entering specific settings for the speed, temperature and pressure of the fuser. If the laminate type is the default type or if a required user-selection of laminate type has been completed, the printing device may adjust the fuser speed, temperature, and/or pressure to execute the laminate function according to the laminate type, as indicated at 112.

The printing device receives composite media into the media-transport path, as indicated at 114. Composite media may be received into the media-transport path via a manual feed tray, but it may be received from an automatic feed tray. The printing device transports the composite media along the media-transport path, as indicated at 116. The composite media is transported through the fuser, where it is laminated, as indicated at 118. Finally, the laminated composite media exits the media-transport path at an output, as indicated at 120. An output door is opened to permit the laminated composite media to exit without folding back on itself.

While the present disclosure has been made with reference to the foregoing example embodiments, those skilled in the art will understand that many variations may be made therein without departing from the spirit and scope defined in the following claims. The disclosure should be understood to include all novel and non-obvious combinations of elements described herein, and claims may be presented in this or a later application to any novel and non-obvious combination of these elements.

What is claimed is:

1. A method of using a printing device having a toner fuser to laminate a composite media including media sheet with at least one laminate material sheet, the method comprising:

receiving a laminate request;

identifying the composite media;

adjusting a characteristic of the toner fuser of the printing device based on the identified composite media; and passing the composite media through the toner fuser to effect lamination within the printing device.

2. The method of claim 1, wherein passing the composite media through the toner fuser includes passing the media sheet through the toner fuser interposed a pair of laminate material sheets.

3. The method of claim 1, wherein adjusting the characteristic of the toner fuser includes adjusting a temperature of the toner fuser.

4. The method of claim 1, wherein adjusting the characteristic of the toner fuser includes adjusting the speed at which the composite media passes through the toner fuser.

5. A method of using a printing device having a toner fuser to laminate a media sheet with at least one laminate material sheet, the method comprising:

receiving a laminate request;

adjusting the pressure exerted by the toner fuser based on identifying the media sheet and the laminate material sheet; and passing the media sheet and the at least one laminate material sheet through the toner fuser to effect lamination within the printing device.

6. The method of claim 1, further comprising:

receiving the composite media into a media-transport path in the printing device;

transporting the composite media along the media-transport path through the toner fuser; and outputting a laminated media sheet from the media-transport path.

7. The method of claim 6, wherein receiving the composite media includes receiving the media sheet and at least one laminate material sheet from a manual feed tray of the printing device.

8. A method of using a printing device having a toner fuser to laminate a media sheet with at least one laminate material sheet, the method comprising:

receiving a laminate request;

adjusting a characteristic of the toner fuser of the printing device;

receiving the media sheet and at least one laminate material sheet into a media-transport path in the printing device, wherein receiving the media sheet and at least one laminate material sheet includes receiving the media sheet and at least one laminate material sheet from an automatic feed tray of the printing device;

passing the media sheet and the at least one laminate material sheet through the toner fuser to effect lamination within the printing device; and outputting a laminated media sheet from the media-transport path.

9. A method of using a printing device having a toner fuser to laminate a media sheet with at least one laminate material sheet, the method comprising:

receiving a laminate request;

displaying instructions on a device display, the instructions defining how to configure the printing device to effect lamination;

configuring a characteristic of the toner fuser of the printing device; and passing the media sheet and the at least one laminate material sheet through the toner fuser to effect lamination within the printing device.

10. The method of claim 9, wherein displaying instructions includes displaying instructions to open and load a manual feed tray.

11. The method of claim 1, wherein receiving the laminate request includes receiving the laminate request via a printing device user interface.

12. A device comprising:

a media-transport path having at least one media input and at least one media output, wherein the media-transport path includes a selectively operable bypass of the image-transfer mechanism;

an image-transfer mechanism positioned along the media-transport path; and a fuser system positioned along the media-transport path, downstream of the image-transfer mechanism, and configured with at least one adjustable fusing characteristic to selectively alternatively effect either fusing of toner to a media sheet, or lamination of the media sheet to a laminate material sheet passed through the fuser system with the media sheet.

13. The device of claim 12, wherein the at least one adjustable fusing characteristic includes one or more of fuser temperature, fuser speed, and fuser pressure.

14. The device of claim 12, wherein the input of the media-transport path includes a manual feed tray.

15. The device of claim 13, wherein the media-transport path moves media substantially in a first direction.

* * * * *